United States Patent [19]

Kohyama

[11] Patent Number: 4,579,081

[45] Date of Patent: Apr. 1, 1986

[54] DEVELOPING APPARATUS

[75] Inventor: Mitsuaki Kohyama, Tokyo, Japan

[73] Assignee: Kabushiki Kaisha Toshiba, Kawasaki, Japan

[21] Appl. No.: 646,160

[22] Filed: Aug. 31, 1984

[30] Foreign Application Priority Data

Aug. 31, 1983 [JP] Japan ..... 58-161253

[51] Int. Cl.[4] ..... G03G 15/06

[52] U.S. Cl. ..... 118/651; 118/653

[58] Field of Search ..... 118/657, 651, 658, 653

[56] References Cited

U.S. PATENT DOCUMENTS 3,232,190 2/1966 Willmott et al. ..... 355/3 R
3,866,574 2/1975 Hardennrook et al. ..... 118/647
4,226,524 10/1980 Hashimoto ..... 118/657 X
4,232,628 11/1980 Shelffo et al. ..... 118/653
4,380,966 4/1983 Isaka et al. ..... 118/657 X
4,406,535 9/1983 Sakamoto et al. ..... 118/658 X

*Primary Examiner*—Bernard D. Pianalto
*Attorney, Agent, or Firm*—Cushman, Darby & Cushman

[57] ABSTRACT

In a developing apparatus for depositing developer particles to a latent image formed on an image carrier to develop the latent image in a development position, a developing roller is arranged in a developer storing chamber to support the developer fed therein and to feed the developer to the development position. The developing roller is arranged such that an elastic blade presses the developer against the developing roller to form a thin developer layer. The developing apparatus has pressure adjusting mechanisms for easily adjusting the pressure of the elastic blade which acts on the developing roller.

15 Claims, 8 Drawing Figures

DEVELOPING APPARATUS

BACKGROUND OF THE INVENTION

The present invention relates to a developing apparatus for depositing developer particles onto a latent image formed on an image carrier so as to obtain a visible image.

Conventional developers used in a developing apparatus of this type include one-component developers and two-component developers. A two-component developer consists of a toner contributing to development and a carrier for properly charging this toner. However, in such a two-component developer, a mixing ratio of the toner to the carrier must be kept constant. In other words, the toner concentration must be kept constant. However, it is difficult to maintain a constant toner concentration. On the other hand, a one-component developer has an advantage in that the concentration can be easily controlled since only the toner for contributing to development is contained in the developer.

One-component developers are classified into magnetic and nonmagnetic developers. Magnetic developers contain magnetic particles in the nonmagnetic developer particles. When such a magnetic developer is used in accordance with a conventional method, a magnet is arranged on a developer carrier for carrying the developer into the developing position so that the magnet generates a magnetic field for supporting the developer on the developer carrier. The following problems occur when the magnetic developer is used.

(1) The developer carrier becomes complicated, has a high cost and is large in size since the magnet must be supported by the developer carrier.

(2) The magnetic developer containing magnetic particles is more expensive than a nonmagnetic developer.

(3) Since the magnetic developer contains magnetic particles which do not contribute to development, color reproducibility is not very good. As a result, it is difficult to perform color development by pressing the magnetic developer.

To eliminate these drawbacks, a developing apparatus which uses a nonmagnetic developer has been proposed. When a nonmagnetic developer is used, it must form a thin layer on the developer carrier. If a thick layer is formed, it is liable to have a nonuniform thickness. Further, in this case, the developer particles may be electrically charged to different degrees. Consequently, a good image cannot be obtained.

In a conventional developing apparatus using a one-component nonmagnetic developer, a blade (press member) is arranged to apply the developer to the developer carrier so as to charge the developer by friction. However, since this blade is arranged only to charge the developer, the blade is firmly fixed on the developing apparatus by screws.

In order to form a thin uniform film of developer on the developer carrier, the pressure of the blade (press member) with respect to the developer carrier must be set at a predetermined value. However, in the conventional construction, the blade is firmly fixed by screws or the like on the developing apparatus, and the pressure of the blade with respect to the developer carrier cannot be adjusted. Moreover, the conventional apparatus which does not have adjusting mechanism is difficult to readjust the pressure, and thus is unusable.

SUMMARY OF THE INVENTION

It is an object of the present invention to provide a developing apparatus capable of easily adjusting the pressure of a press member with respect to a developer carrier.

According to the aspect of the present invention, there is provided a developing apparatus for depositing developer particles on a latent image formed on a surface of an image carrier and developing the latent image in a development position opposite an image carrier, comprising; a developer carrier, spaced apart from said image carrier, for carrying the developer to the development position; feeding means for feeding the developer to the developer carrier; a press member for pressing the developer against said developer carrier to form the developer layer on the developer carrier; and adjusting means for adjusting the pressure of said press member which acts on said developer carrier.

DETAILED DESCRIPTION OF THE PREFERRED EMBODIMENTS

Developing apparatuses according to preferred embodiments of the present invention will be described with reference to FIGS. 1 to 8.

Figure 1:
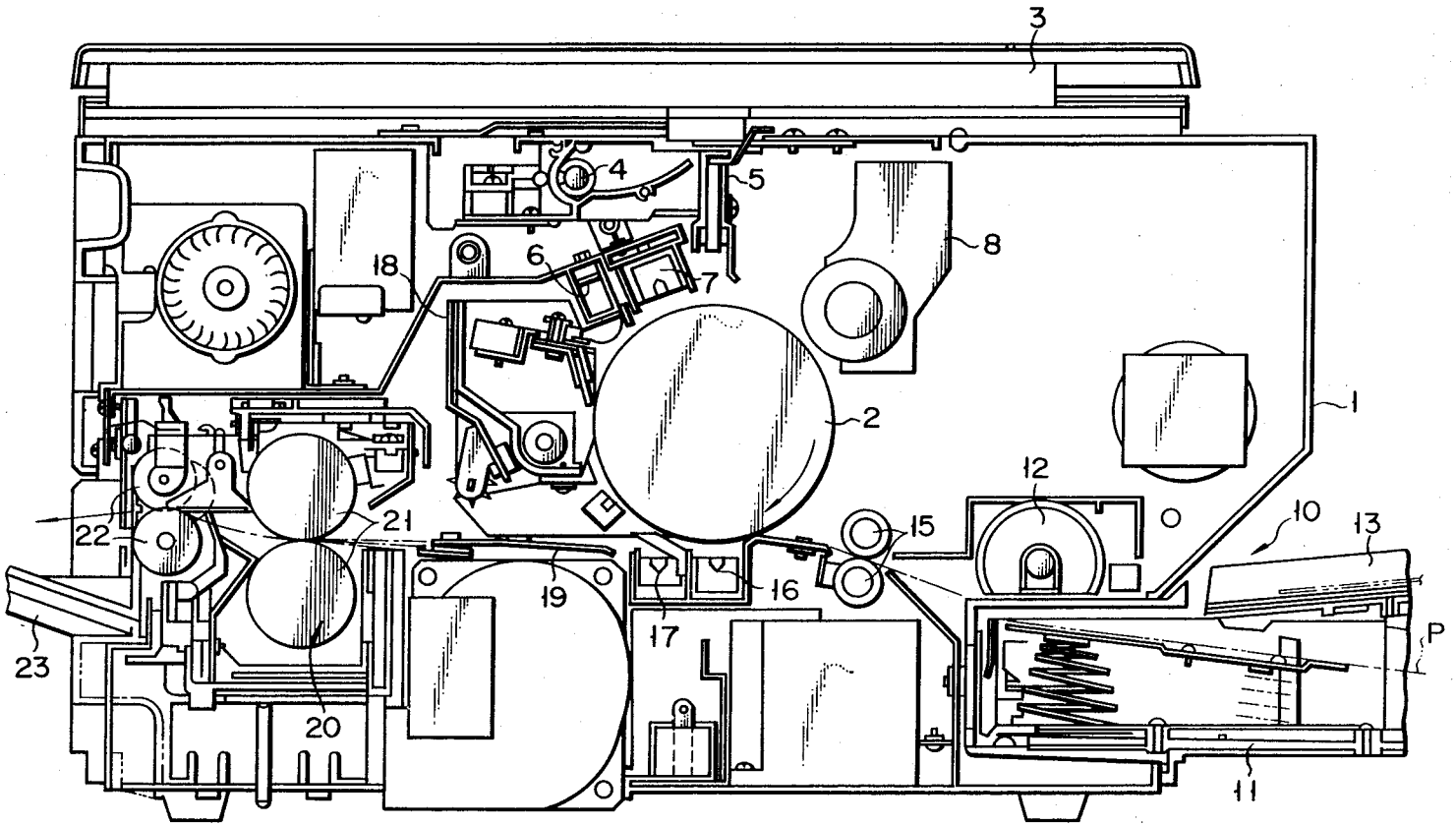
FIG. 1 is a schematic sectional view of a developing apparatus according to an embodiment of the present invention.

An image forming apparatus such as a copying machine to which the developing apparatus according to of the invention will be described. FIG. 1 is a sectional view schematically showing the copying machine. In FIG. 1, numeral 1 designates a housing of the copying machine. Rotatably disposed in the central portion of the housing 1 is an image carrier, e.g., a photoconductive or photosensitive drum 2 made of selenium, on the surface of which is formed an electrostatic latent image. The photosensitive drum 2 is surrounded by a lamp 4 and a convergent light transmitting member 5 for optically scanning an original paper put on a horizontally reciprocating original table 3 and for forming an electrostatic latent image corresponding to an image of the original paper on the surface of the photosensitive drum 2, a discharge lamp 6 for de-electrifying the surface of the photosensitive drum 2 before the formation of the original image, a charger 7 for uniformly charging the surface of the photosensitive drum 2 after the de-electrification, and a developing apparatus 8 according to the invention for selectively drawing a developer or developing agent to the electrostatic latent image on the surface of the photosensitive drum 2 to develop the electrostatic latent image. Thus, the developing apparatus 8 forms a visible image on the surface of the photosensitive drum 2.

A paper feeding section 10 is provided at one side portion (right-hand side portion of FIG. 1) of the housing 1. The paper feeding section 10 includes a paper cassette 11 removably attached to the one side portion of the housing 1, a paper supply roller 12 in rolling contact with the uppermost sheet P contained in the paper cassette 11 and capable of delivering the sheets P one by one into the housing 1, and a sheet-bypass guide 13 for manual paper supply. Each sheet P delivered from the paper feeding section 10 is regulated for feed timing by a pair of aligning rollers 15, and is fed so as to be in rolling contact with the photosensitive drum 2 in a transfer section.

The photosensitive drum 2 is also surrounded by a transfer charger 16 for transferring the developing agent to the sheet to form a visible image thereon, and a separation charger 17 for separating the sheet from the photosensitive drum 2 after transfer. The transfer section is defined between the photosensitive drum 2 and the transfer charger 16. After the developing agent image (visible image) is transferred to the sheet, the sheet is guided to a fixing unit 20 by a conveyor belt 19. The developing agent is fixed by the pressure and heat of a pair of heat rollers 21 which constitute the fixing unit 20. After fixation, the sheet is discharged onto a tray 23 by a pair of exit rollers 22. After the transfer operation, the developer remaining on the surface of the photosensitive drum 2 is removed by a cleaning unit 18.

The developing apparatus 8 according to an embodiment of the present invention will be described with reference to FIGS. 2 and 3.

A one-component nonmagnetic developer is stored in the developing apparatus 8. The developing apparatus 8 has a housing 31 for storing the developer. The housing 31 has a back frame 30A, and side frames 30B and 30C spaced apart at sides of the back frame 30A. A front frame 30D as a movable member is pivotally supported to the side frames 30B and 30C through pins 32 at the front portion of the housing 31. A developer chamber 30E is formed in the housing 31. Shielding members 30F and 30G made of a material such as urethane foam having a relatively small friction coefficient are formed along the side frames 30B and 30C in the chamber 30E. The shielding members 30F and 30G do not interfere with the pivotal movement of the front frame 30D but prevent the developer from leaking from the chamber 30E. The operation of the shielding members 30F and 30G will be described in detail later. A cover 33 is formed at an upper opening 31A in the housing 31 and can be freely opened to replenish the chamber 30E with the developer. Another opening 31B for supplying developer to the photosensitive drum 2 is formed at the bottom of the housing 31. A cylindrical developing roller 35 made of, for example, aluminum or stainless steel is rotatably supported by the side frames 30B and 30C in the vicinity of the opening 31B and serves as a developer carrier for carrying the developer on its surface and feeding the developer. An elastic blade 36 is arranged between the front frame 30D and the developing roller 35 and is pressed against the developing roller 35 to apply to its surface the developer T inserted between the blade 36 and the developing roller 35. The blade is made of, for example, a silicone butadiene rubber (of a hardness of 40 to 45 degrees), urethane rubber, stainless steel, phosphor bronze (of a thickness of about 0.07 mm to 0.2 mm) or urethane sheet. One end portion of the elastic blade 36 is fixed by screws on the front frame 30D through a blade holder 37. The proximal portion of the elastic blade 36 is fixed by screws at the lower end portion of the front frame 30D in such a manner that a surface portion of the elastic blade 36 which opposes the developing roller 35 presses the peripheral surface of the developing roller 35, shown in FIG. 3.

Two pressure adjusting mechanisms 34 are mounted on both sides of the front frame 30D to adjust the pressure of the elastic blade 36 which acts on the developing roller 35, respectively. The adjusting mechanisms 34 make the surface portion of the elastic blade 36 press the developing roller 35 by pivoting the front frame 30D. Each adjusting mechanism 34 comprises an adjusting screw 34A rotatably inserted in a front portion of the front frame 30D and a support member 34B for pivotally supporting the adjusting screw 34A and defining the axial movement of the screw 34A. One end of one support member 34B is fixed at the side frame 30B and one end of the other support member 34B is fixed at the side frame 30C.

Figure 4:
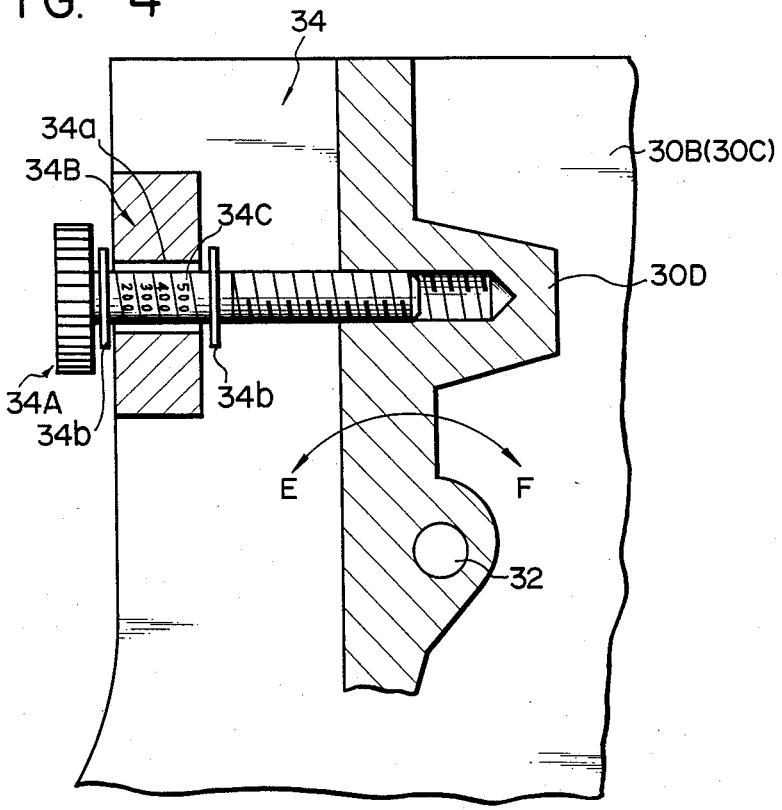
FIG. 4 is a schematic sectional view showing the main part of an adjusting mechanism in the developing apparatus shown in FIG. 2.

As shown in FIG. 4, a through hole **34*a* is formed in the support member 34B of each of the pressure adjusting mechanisms 34. Each adjusting screw 34A is screwed in the corresponding through hole 34*a*. Stop rings 34*b* are inserted at the front and rear surfaces of the support member 34B to define the movement of the adjusting screw 34 along the axial direction thereof. A scale 34C is marked on the adjusting screw 34A so as to represent the pressure of the elastic blade 36 which acts on the developing roller 35 upon rotation of the adjusting screw 34A**.

In each of the pressure adjusting mechanisms 34 having the construction described above, when the operator turns the adjusting screw 34 clockwise, the front frame 30D is rotated in the direction indicated by arrow E, so that the pressure of the elastic blade 36 with respect to the developing roller 35 is increased. However, when the adjusting screw 34A is rotated counterclockwise, the front frame is rotated in a direction given by arrow F. In this case, the pressure of the elastic blade 36 which acts on the developing roller 35 is decreased.

Figure 5:
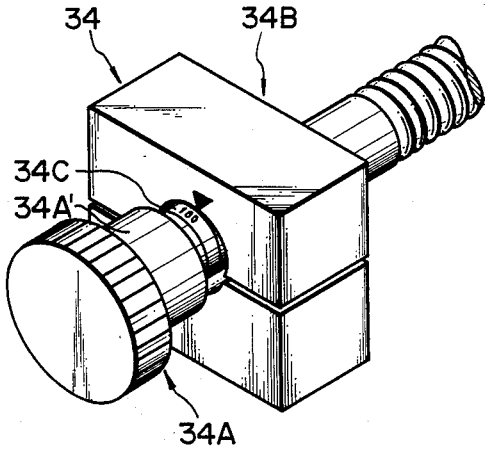
FIG. 5 is a schematic perspective view showing part of the adjusting mechanism in FIG. 4.

Another construction of the adjusting screw 34A and the support member 34B is illustrated in FIG. 5. In this case, a step 34A' is formed in a nonthreaded portion of the adjusting screw 34A. The holder 34B is split into two pieces, so that a portion having a scale 34C is rotatably supported. In the construction shown in FIG. 5, since the support member 34B is cut into two pieces, the pressure adjusting mechanism can be easily assembled.

The surface portion of the elastic blade 36 which is opposite the developing roller 35 presses the developing roller 35 by means of an elastic force caused by distortion of the elastic blade 36. As compared with a conventional elastic blade whose free end portion presses the developing roller 35, the contact area between the elastic blade 36 and the developing roller 35 can be increased. Therefore, fine adjustment of the pressure of the elastic blade 36 with respect to the developing roller 35 can be easily performed, and a uniform pressure can act on the developing roller 35. The developer particles are subjected to uniform friction under pressure and can be uniformly charged. The developing apparatus 8 is located at a position (i.e., a transfer or developing position) M where the developer applied to the developing roller 35 is not brought into contact with the photosensitive drum 2. The noncontact positional relationship between the developer on the developing roller 35 and the photosensitive drum 2 is determined by the size of the particles of the developer and the thickness of the developer layer coated on the developing roller 35. In order to properly attract the developer particles to the photosensitive drum 2 to obtain a good visible image, the distance between the developing roller 35 and the photosensitive drum 2 must be minimal. In addition, the developer layer must be thin. The range of particle sizes of the developer is determined in accordance with the resolution of the image. Therefore, the gap between the photosensitive drum 2 and the developing roller 35 at the development position M preferably falls within the range between 10 μm and 300 μm. In order to maintain this gap, gap regulation rollers 39 (FIG. 2) are coaxially mounted on the developing roller 35 and can be rotated therewith. These regulation rollers 39 are brought into contact with rollers (not shown) mounted at two ends of the shaft of the photosensitive drum 2, so that a constant distance between the shafts of the developing roller and the photosensitive drum 2 can be maintained. A power source 40 is connected to the developing roller 35 to form an electric field between the photosensitive drum 2 and the developing roller 35 at the development position M. The power source 40 generates a DC voltage or a level-shifted AC voltage. When the voltage from the power source 40 is applied to the developing roller 35, an electric field is formed between the photosensitive drum 2 and the developing roller 35 so as to easily attract the developer particles from the developing roller 35 to the surface of the photosensitive drum 2. However, the power source 40 need not be used. The charged developer on the developing roller 35 can be sufficiently attracted to the surface of the photosensitve drum 2 by an electrostatic attraction force generated by the latent image charge.

Figure 6:
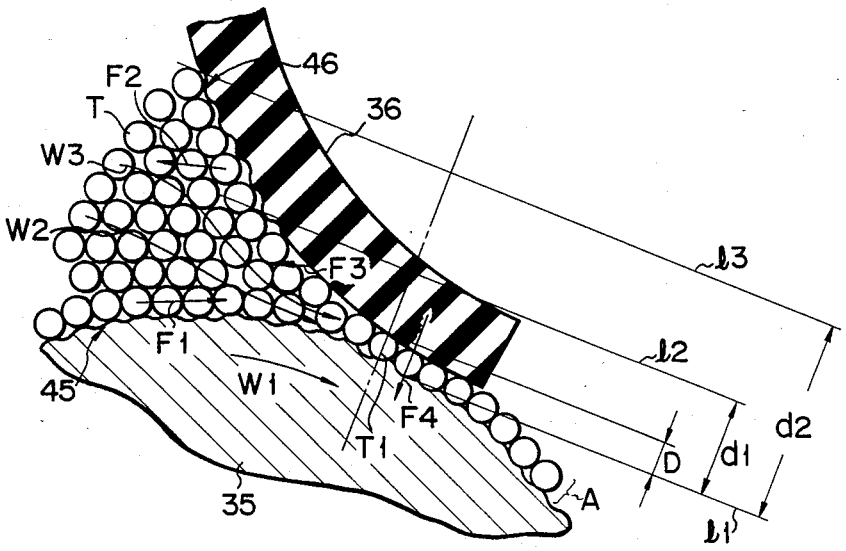
FIG. 6 is a sectional view showing a state in which an elastic blade presses a developing roller in the developing apparatus shown in FIG. 2.
Figure 7:
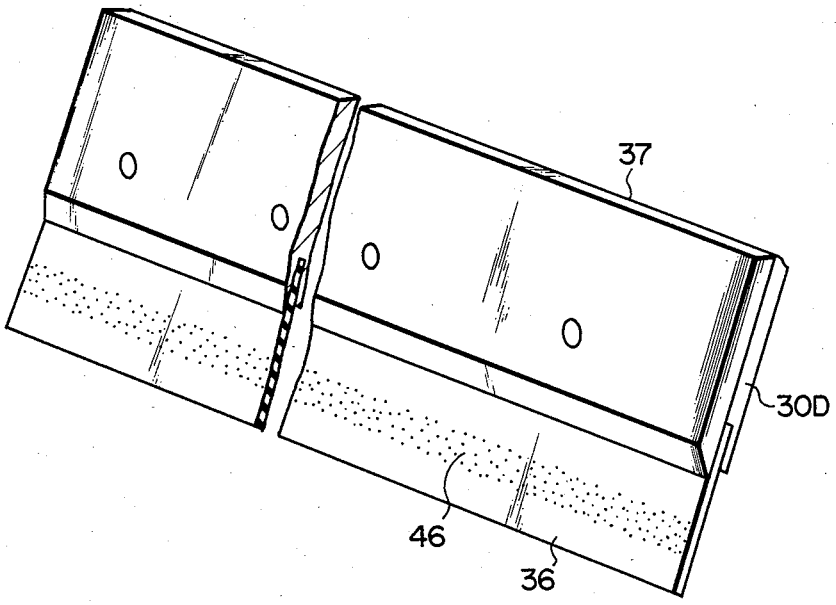
FIG. 7 is a perspective view of the elastic blade shown in FIG. 2.

The developing roller 35 and the elastic blade 36 will be described in detail with reference to FIGS. 6 and 7. As shown in FIG. 6, a first coarse surface 45 is formed on the peripheral surface of the developing roller 35. A second coarse surface 46 is formed on the elastic blade 36 opposite the developing roller 35. The first coarse surface 45 has a coarseness of 0.07D to 1.5D when the particle size of the developer is given to be D. The first coarse surface is roughened by sand blasting or buffing. As shown in FIG. 2, the first coarse surface 45 has a development area having a maximum development width a corresponding to a maximum image formation width of the photosensitive drum 2. Nondevelopment areas each having a width b are formed at two sides of the development area. The nondevelopment areas are not subjected to the special roughening treatment.

Referring to FIG. 6, reference symbol T1 denotes any developer particle. Assume that the tangent at a contact point between the developer particle T1 and the developing roller 35 is given to be l1, that the distance spaced apart from the tangent l1 by about 2 to 3 times the particle size D of the particle is given to be d1, that the line parallel to the tangent l1 is given to be l2, that the distance the tangent l1 which is about 10 to 50 times the particle size D of the developer particle is given to be d2, and that the line parallel to the tangent l1 is given to be l3.

The second coarse surface 46 is formed in a noncontact area (e.g., an area between the distances d1 and d2) between the developing roller 35 and the elastic blade 36. When the second coarse surface 46 is observed along the longitudinal direction of the elastic blade 36, the second coarse surface 46 extends from one end to the other end along the entire length (i.e., the axial direction of the developing roller 35) of the elastic blade 36, as shown in FIG. 7. The second coarse surface 46 has a coarseness of 0.1D to 2.0D and is roughened by sand blasting or buffing.

The operation and effect of the developing apparatus 8 will be described hereinafter. The pressure of the elastic blade 36 which acts on the developing roller 35 is adjusted by turning the adjusting screws 34A. When each of the adjusting screw 34A is turned, the front frame 30D coupled to the corresponding adjusting screw 34A is pivoted about the corresponding pin 32 in a direction indicated by arrow E or F since the axial movement of the adjusting screw 34A is regulated by the engagement between the stop ring **34*b* and the holder 34*a*. The pivot direction and angle of the front frame 30D adjusts the pressure of the elastic blade 36 which acts on the developing roller 35. In this case, the pressure can be adjusted in accordance with the scales 34C marked on the adjusting screws 34A. The pressure of the elastic blade 36 which acts on the developing roller 35 can be adjusted within the range of 0 to 500 g/cm. The optimum pressure falls within the range between 70 and 200 g/cm. Therefore, according to this embodiment, a predetermined pressure can be extremely easily achieved by turning the adjusting screws 34A**. Conventionally, the elastic blade set screws are loosened to adjust the pressure of the elastic blade in accordance with the experience, while the elastic blade is held by hand. According to this embodiment, the pressure of the elastic blade can be accurately adjusted in a simple manner, and the operator need not contact the elastic blade.

In conventional developing apparatuses, assembly errors often happen. When pressure at the two ends of the elastic blade with respect to the developing roller differ from each other, a spacer is inserted between the front frame and the elastic blade. However, according to this embodiment, the adjusting screws 34 are fixed at end portions of the elastic blade 36 along the longitudinal direction thereof. When the two adjusting screws 34 are adjusted at proper pressures, respectively, unlike in the conventional developing apparatus, a spacer need not be inserted between the front frame and the elastic blade. Therefore, uniform pressure adjustment can be easily performed.

As shown in FIG. 6, when the pressure of the elastic blade 35 which acts on the developing roller 35 is adjusted, the developer T is filled in the developing apparatus 8. Then the developing roller 35 is rotated in a direction indicated by arrow W1. The developer T is fed in the W1 direction and is electrically charged between the elastic blade 36 and the developing roller 35. In this case, since the first coarse surface 45 is formed on the surface of the developing roller 35, the feed force F1 of the developer on and in the vicinity of the developing roller 35 is increased, so that the developer (developer particles) T can be properly fed in the direction indicated by arrow W1 and can be moved and displaced. Since the elastic blade 36 has a second coarse surface 46, the developer on the second coarse surface 46 receives a relatively large resistant force F2. Therefore, the flow speed of the developer particles T in the vicinity of the second coarse surface 46 is lowered. On the other hand, the portion (indicated by the distance d1 in FIG. 6) downstream of the second coarse surface 46 has not been subjected to a roughening treatment. The development particles on this portion receive a relatively low resistant force F3 and are smoothly fed. Therefore, the developing particles T inserted between the elastic blade 36 and the roller 35, which receives an urging force F4 are smoothly moved and displaced along the directions indicated by arrows W2 and W3. In the portion downstream of and closer to the elastic blade 36, the thickness of the developer layer is decreased. A uniform single particle layer is applied to the developing roller 35 at the portion downstream of the elastic blade 36. In this manner, the developer particles inserted in the elastic blade 36 can be smoothly moved and displaced. The thickness of the developer can be gradually decreased, so that degradation in the flowability of the developer particles T, so that an irregular layer thickness, and so that mixing of a foreign material in the developer can all be prevented. Therefore, the elastic blade 36 will not be moved upward, and a nonuniform thickness of the developer layer and a nonuniform charging of the developer can also be prevented.

Referring again to FIG. 3, the toner particles T applied as a uniform thin layer to the surface of the developing roller 35 are fed to the developing position M opposite the photosensitive drum 2. In this developing position M, the charged developer particles of the thin layer are selectively attracted by the electric field formed between the developing roller 35 and the photosensitive drum 2 to the surface of the photosensitive drum 2, so that the latent image is visualized. Since the developer particles applied to the developing roller constitute the uniform thin layer as described above, the selectively attracted developer particles are uniformly distributed on the latent image, thereby obtaining a good visible image. In addition to this advantage, the gap between the developing roller 35 and the photosensitive drum 2 can be slightly larger than the thickness of the developer layer, thus satisfying the need for minimizing the gap between the developing roller 35 and the photosensitive drum 2 so as to obtain a good visible image. Furthermore, for the same reason as described above, a noncontact visible image can be properly obtained even if the one-component nonmagnetic developer is used. A highly reliable application can be provided when the development steps are repeated in color development. In this manner, noncontact development can be performed, so that the developer carrier (developing roller) will not be brought into contact with the image carrier (photosensitive drum), thereby preventing any damage to the image carrier and its deterioration over time. "Noncontact development" here means that the image carrier is opposite and is spaced apart from a developer layer on the developer carrier, and that the developer particles are attracted to only the image portion of the latent image formed on the image carrier.

Another embodiment of the present invention will be described with reference to FIG. 8. The same reference numerals as in FIG. 8 denote the same parts as in the embodiment described above, and a detailed description thereof will be omitted.

Figure 2:
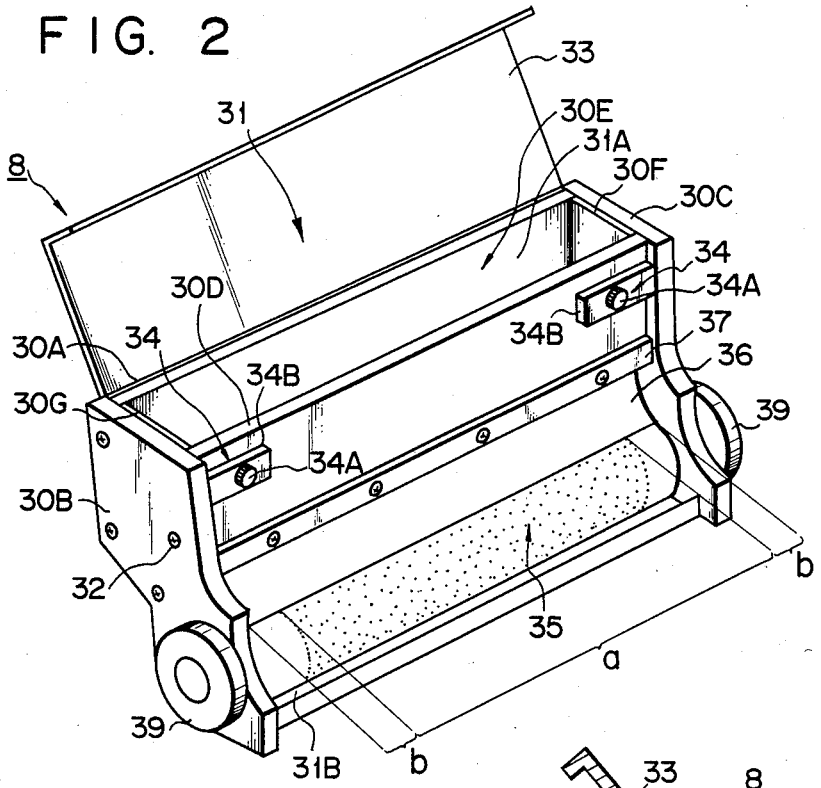
FIG. 2 is a schematic perspective view of the developing apparatus shown in FIG. 1.
Figure 3:
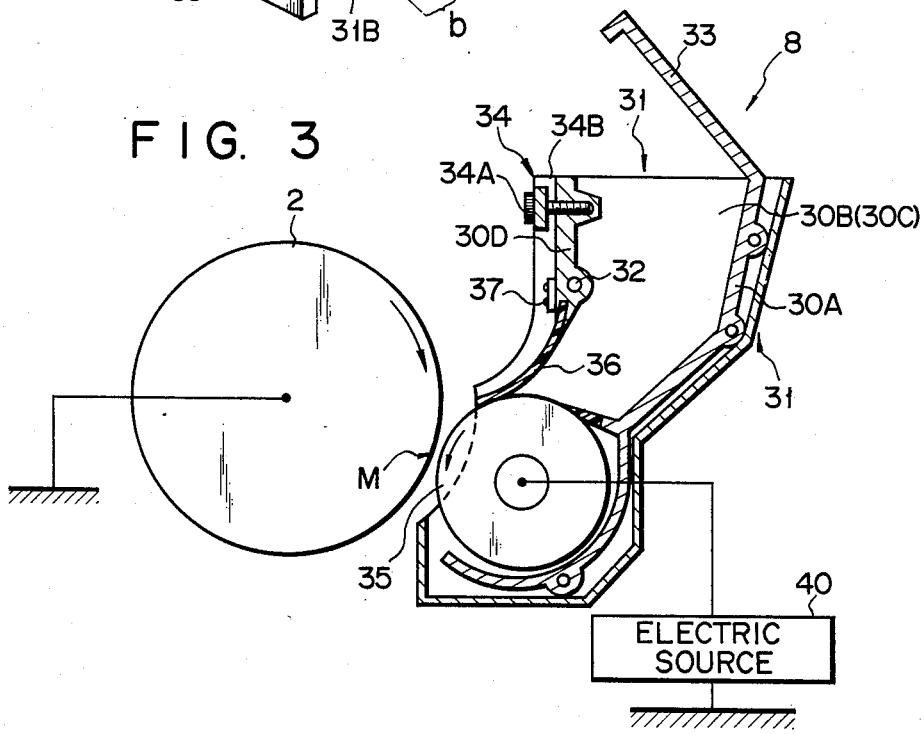
FIG. 3 is a schematic sectional view of the developing apparatus shown in FIG. 2.
Figure 8:
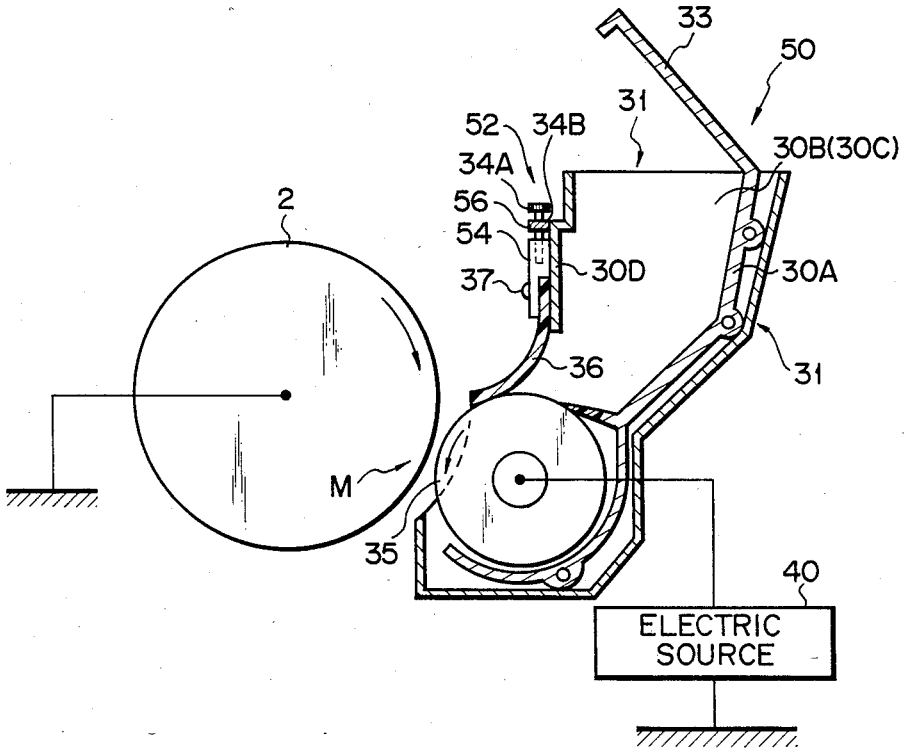
FIG. 8 is a schematic sectional view showing a developing apparatus according to another embodiment of the present invention.

Pressure adjusting mechanisms 52 in place of the pressure adjusting mechanisms 34 shown in FIGS. 2 to 4 are arranged in a developing apparatus 50 in FIG. 8. In each of the pressure adjusting mechanisms 52 shown in FIG. 8, an adjusting screw 34A is turned away from the opening of a cover 33 (i.e., from the upper direction of the apparatus). A clamp member 54 for clamping one end portion of an elastic blade 36 is disposed on a front frame 30D and is slidable substantially vertically along the front frame. A female thread portion is formed at the upper portion of the slidable clamp member 54 and can be engaged with the adjusting screw 34A. A support member 56 is fixed at the upper portion of the front frame 30D to support the adjusting screw 34A. A through hole is formed in the support member 56 and can be engaged with the adjusting screw 34A. The adjusting screw 34A has a male threaded portion at the lower end portion thereof. This lower end portion is engaged with the female threaded portion formed in the clamp member 54. According to this embodiment, when the operator turns the adjusting screw 34A, the elastic blade 36 is linearly moved along the substantially vertical direction, thereby changing the distortion amount of the elastic blade 36 along the vertical direction. When the distortion amount of the elastic blade 36 changes, the pressure of the elastic blade which acts on a developing roller 35 changes. For example, when the adjusting screw 34A is rotated clockwise, the clamp member 54 is moved downward along the front frame 30D. In this case, the elastic blade 36 is further distorted, thereby increasing the elastic force of the blade and hence increasing the pressure of the elastic blade 36 which acts on the developing roller 35. It should be noted that the pressure adjusting screw had a scale in the same manner as in the first embodiment. According to the second embodiment, the pressure adjusting screw can be turned from the upper side (i.e., from the side of the cover 33), thereby requiring only a small space for adjustment.

The present invention is not limited to the particular embodiments described above. Various changes and modifications can be made within the spirit and scope of the present invention.

The two pressure-adjusting mechanisms are mounted on the front frame along the longitudinal direction thereof in each of the above embodiments. However, three or four pressure-adjusting mechanisms may be arranged to obtain the same effect as in the embodiment of the present invention.

Any one-component magnetic developer may be used in place of the nonmagnetic developer. The developer carrier may be made of a metal plate or belt in place of a metal (e.g., aluminum or stainless steel) drum. In addition, the surface of the metal plate or belt may be treated with Alumite or plated with chromium. When such a treatment is performed, the first coarse surface of the developer carrier will not easily wear, thereby stabilizing the developing over time and prolonging the service life of the developer carrier. The latent image developed by the developing apparatus according to the present invention is not limited to the electrostatic latent image formed by the copying machine shown in FIG. 1, but may be extended to a charge pattern formed by a cathode ray tube, a laser beam, a needle electrode, a light-emitting diode or the like. In each of the above embodiments, the front frame is pivotally supported in the housing of the developing apparatus and supports the elastic blade so as to constitute part of the chamber together with the housing. However, the arrangement of the front frame is not limited to this. Although the developing apparatus is compact in the above embodiment, the elastic blade may alternatively be supported by a movable member provided independently of the front frame. Furthermore, the pressure adjusting mechanism can be replaced with a mechanism using a link mechanism or a cam mechanism. The present invention can also be applied to a developing apparatus using a contact development technique.

What is claimed is:

1. A developing apparatus for depositing particles to a latent image formed on a surface of an image carrier to develop the latent image in a development position, comprising:

a developer carrier, spaced apart from said image carrier, for carrying the developer to the development position;

feeding means for feeding the developer to the developer carrier;

press means for pressing the developer against said developer carrier to form the developer layer on the developer carrier; and pressure adjusting means for selectively adjusting a pressure of said press means which is exerted upon said developer carrier; wherein said press means includes an elastic blade consisting essentially of an elastic material capable of exerting an elastic force, said elastic blade having an end portion disposed in opposing parallel relationship to said developer carrier which presses the developer against said developer carrier by the elastic force of said elastic blade; and wherein said pressure adjusting means includes (a) mounting means for mounting said elastic blade in relation to said developer carrier such that said end portion is disposed in said opposing parallel relationship to said developer carrier and for mounting said elastic blade for pivotal movements about an axis which is parallel to said developer carrier, and (b) screw adjustment means having a threaded portion threadably coupled to said mounting means for translating turning movements applied to said screw adjustment means into pivotal movements of said mounting means about said axis to thereby responsively change pivot angles of said mounting means and thus adjust the elastic force exerted by said elastic blade end portion.

2. An apparatus according to claim 1, wherein said feeding means has a housing for containing the developer, said pivot means being part of said housing.

3. An apparatus according to claim 2 wherein said screw adjustment means includes means defining a scale for representing the force of said elastic blade end portion which is exerted upon said developer carrier.

4. An apparatus according to claim 3, wherein said pressure adjusting means further includes support means for supporting said screw adjustment means and for defining the extent of movement of said screw adjustment means.

5. An apparatus according to claim 4, wherein said support means includes a pair of clamp pieces which clamp and support said screw adjustment means.

6. An apparatus according to claim 1, wherein the developer is a nonmagnetic developer.

7. An apparatus according to claim 1 further comprising means for impressing the developer with a voltage to thereby charge the developer such that the developer in the development position exhibits a relatively high potential thereby to more readily transfer the developer from said development carrier to said image carrier.

8. A developing apparatus for depositing developer particles upon a surface of an image carrier having a latent image formed thereon, said apparatus comprising:

developer carrier means having a developer carrier surface carrying a layer of developer particles to close proximity to the image carrier at an image-developing position;

feed means for feeding the developer particles to said developer carrier means;

elastic blade means having a lower end portion in operative juxtaposition with said developer-carrier surface of said developer carrier means for exerting an elastic pressing force against said developer-carrier surface to form said layer of developer particles on said developer-carrier surface;

mounting means fixed to an upper end portion of said elastic blade means for mounting said elastic blade means for pivotal movements, about an axis parallel to said developer carrier means, between (a) a first position wherein a greater elastic pressing force is exerted against said developer-carrier surface and (b) a second position wherein a lesser elastic pressing force is exerted against said developer-carrier surface; and pressure adjusting means coupled to said mounting means for pivotally moving said mounting means about said axis between said first and second positions to thereby selectively adjust the pressing force of said elastic blade means exerted against said developer-carrier surface between said greater and lesser forces, respectively, said pressure adjusting means including screw adjustment means threadably coupled to said mounting means for translating turning movement applied to said screw adjustment means into pivotal movement of said mounting means about said axis between said first and second positions to thereby responsively change pivot angles of said mounting means and thus adjust said pressing force exerted upon said developer-carrier surface by said lower end portion of said elastic blade means.

9. A developing apparatus as in claim 8 wherein said screw adjustment means includes knob means for permitting manual manipulation of said adjusting screw means to transfer turning movements applied to said screw adjustment means.

10. A developing apparatus for depositing developer particles upon a surface of an image carrier having of a latent image formed thereon, said apparatus comprising:

developer carrier means having a developer carrier surface carrying a layer of developer particles to close proximity to the image carrier at an image-developing position;

feed means for feeding the developer particles to said developer carrier means;

elastic blade means having a lower end portion in operative juxtaposition with said developer-carrier surface of said developer carrier means for exerting an elastic pressing force against said developer-carrier surface to form said layer of developer particles on said developer-carrier surface;

mounting means fixed to an upper end portion of said elastic blade means for mounting said elastic blade means such that said lower end portion is in said operative juxtaposition with said developer-carrier surface, said mounting means being reciprocally rectilinearly movable towards and away from said developer-carrier surface between (a) a first position wherein said lower end portion of said elastic blade means exerts a greater elastic pressing force against said developer-carrier surface and (b) a second position wherein said lower end portion of said elastic blade means exerts a lesser elastic pressing force against said developer-carrier surface; and pressure adjusting means coupled to said support means for slideably moving said support means between said first and second positions to thereby selectively adjust the pressing force of said lower end portion of said elastic blade means exerted against said developer-carrier surface between said greater and lesser forces, respectively, said pressure adjusting means including screw adjustment means threadably coupled to said support means for translating turning movements applied to said screw adjustment means into said rectilinear movements of said support means towards and away from said developer-carrier surface between said first and second positions to thereby responsively cause said lower end portion of said elastic blade means to exert said greater and lesser elastic pressing forces, respectively, against said developer-carrier surface.

11. A developing apparatus according to claim 10 wherein said mounting means of said pressure adjusting means includes a sliding member which is slidable in a rectilinear direction with respect to said developer carrier means and which supports said elastic blade means, wherein the pressing force of said lower end portion of said elastic blade means which is exerted upon said developer-carrier surface is adjusted in response to movement of said sliding member.

12. A developing apparatus according to claim 11 wherein said screw adjustment means includes means defining a scale for representing the pressing force of said lower end portion of said elastic blade means which is exerted upon said developer-carrier surface.

13. A developing apparatus according to claim 12, wherein said pressure adjusting means includes support means for supporting said screw adjustment means and for defining the extent of threadable movement of said screw adjustment means towards and away from said mounting means.

14. A developing apparatus according to claim 13 wherein said lower end portion of said elastic blade means which is in operative juxtaposition with said developer-carrier surface comprises a first coarse surface.

15. A developing apparatus according to claim 14, wherein said developer-carrier includes a second coarse surface which increases frictional force when said developer carrier is brought into contact with said first coarse surface of said elastic blade.

* * * * *